US006338330B1

(12) United States Patent
Jessberger et al.

(10) Patent No.: US 6,338,330 B1
(45) Date of Patent: Jan. 15, 2002

(54) DEVICE FOR MOVING A VALVE FLAP

(75) Inventors: Thomas Jessberger, Rutesheim; Arthur Klotz, Remseck; Georg Mehne, Mahlberg, all of (DE)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 09/462,599

(22) PCT Filed: Jun. 24, 1998

(86) PCT No.: PCT/EP98/03868

§ 371 Date: Mar. 28, 2000

§ 102(e) Date: Mar. 28, 2000

(87) PCT Pub. No.: WO99/02831

PCT Pub. Date: Jan. 21, 1999

(30) Foreign Application Priority Data

Jul. 11, 1997 (DE) ..... 197 29 648

(51) Int. Cl.[7] ..... F02D 11/08

(52) U.S. Cl. ..... 123/389; 123/401; 251/58; 251/61; 137/907

(58) Field of Search ..... 123/337, 396, 123/367, 400, 403, 568.18, 568.19, 389, 401, 360; 137/614.2, 505.13, 907; 251/58, 61; 261/64.1

(56) References Cited

U.S. PATENT DOCUMENTS

| | | | | | |
|---|---|---|---|---|---|
| 3,741,332 | A | * | 6/1973 | Sakakibara et al. | 123/351 |
| 3,794,787 | A | * | 2/1974 | Berninger | 200/61.89 |
| 3,989,018 | A | * | 11/1976 | Beier | 123/568 |
| 4,210,110 | A | * | 7/1980 | Krebaum et al. | 123/396 |
| 5,345,967 | A | * | 9/1994 | Naffziger | 137/614.2 |
| 5,746,190 | A | * | 5/1998 | Honda | 123/568.18 |
| 5,975,128 | A | * | 11/1999 | Schatz | 137/505.13 |

* cited by examiner

*Primary Examiner*—Andrew M. Dolinar
*Assistant Examiner*—Hieu T. Vo
(74) *Attorney, Agent, or Firm*—Crowell & Moring LLP

(57) ABSTRACT

An apparatus for moving a valve flap, especially in the air intake duct of an internal combustion engine, including a vacuum box (20) which executes a longitudinal movement in dependence on the application of a negative pressure or vacuum, and the longitudinal movement of the vacuum box is transmitted via a coupling rod (16) to a traverse rod (15), which in turn is connected to an actuating lever (13) for the valve flap (11). The coupling rod (16) and traverse rod (15) system allows the vacuum box to be arranged in any position relative to the valve flap (11). The apparatus can be simplified further by combining the diaphragm disk (27) with the coupling rod (16) to form a single, integral part. In this case, a force is exerted eccentrically on the vacuum box. The eccentrically exerted force can be compensated by the diaphragm having a shape other than a round contour.

12 Claims, 2 Drawing Sheets

DEVICE FOR MOVING A VALVE FLAP

BACKGROUND OF THE INVENTION

The invention relates to a device for shifting the position of a valve flap.

Such a device is known from U.S. Pat. No. 4,056,082. For space reasons it may be necessary to provide the vacuum box that is used with a coupling rod which makes possible an eccentric output of the adjusting force which is effected by the vacuum box. In accordance with the aforementioned publication, this is achieved in that the vacuum box is attached to an adjusting mechanism by means of which the output force can be displaced to another location. This, however, gives rise to additional manufacturing expense, which makes the apparatus more costly. In addition, the susceptibility of the apparatus to operational disturbances, e.g. by fouling of the linkage mechanism, is increased. In addition, additional space is required by the adjusting mechanism, and the apparatus is made heavier.

SUMMARY OF THE INVENTION

It is therefore the object of the invention to provide a device for shifting the position of a valve flap which will operate reliably, is simply constructed, has a low weight, requires little space, and at the same time makes possible an eccentric output of force. This object is achieved by the features of claim 1.

The substantial advantage of the invention is that the diaphragm device can be arranged at virtually any place in the vicinity of the valve flap, and the force is applied through the corresponding linkage. In particular, it is possible to arrange the diaphragm device such that it does not negatively affect the design of the overall air intake system but instead adapts itself to the form of the system.

In one practical embodiment of the invention the functions of the transmission of force and the mounting of the diaphragm are integrated in a single component. As a result, the cost of the manufacture of this diaphragm device is but slightly greater in comparison with conventional designs with a centralized application of force, which assures the cost of the proposed solution will be reasonable.

Another embodiment of the invention envisions constructing the transmission ratio of the operating rod to be variable, so that the range of movement of the diaphragm device can easily be adapted to the required flap movement.

It is advantageous to select the shape of the diaphragm such that the actuating force resulting from the pressure on the diaphragm corresponds as nearly as possible to the line of action of the traverse rod or to the point of linkage to the coupling rod. This construction has the advantage that the stress on the joint arranged on the hook plate in the housing of the diaphragm device is minimized and the pressure force of the diaphragm device is almost entirely available as an actuating force.

According to one embodiment of the invention, the diaphragm device is a vacuum box which can also have a diaphragm contour which differs from the conventional round shape. Such vacuum boxes are generally used in motor design; they are very reliable and inexpensive to manufacture.

To connect the coupling rod, traverse rod and valve flap and for the one-sided journaling to the hook plate of the asymmetrical vacuum box, ball joints are preferred. These are hooked or snapped to each other. In this way the assembly costs can be considerably reduced.

It is possible to additionally arrange a length compensating member in the traverse rod or the coupling rod and also to provide the diaphragm device or vacuum box with a return spring. These elements also result in an optimal adaptation to the system.

These and additional features of preferred embodiments of the invention will be found not only in the claims but also in the description and the drawings, the individual features being applicable individually or jointly in the form of subcombinations in embodiments of the invention and in other fields and may constitute advantageous as well as independently patentable embodiments, for which protection is hereby claimed.

The invention will be further explained hereinafter with reference to working embodiments.

DETAILED DESCRIPTION OF PREFERRED EMBODIMENTS

Figure 1:
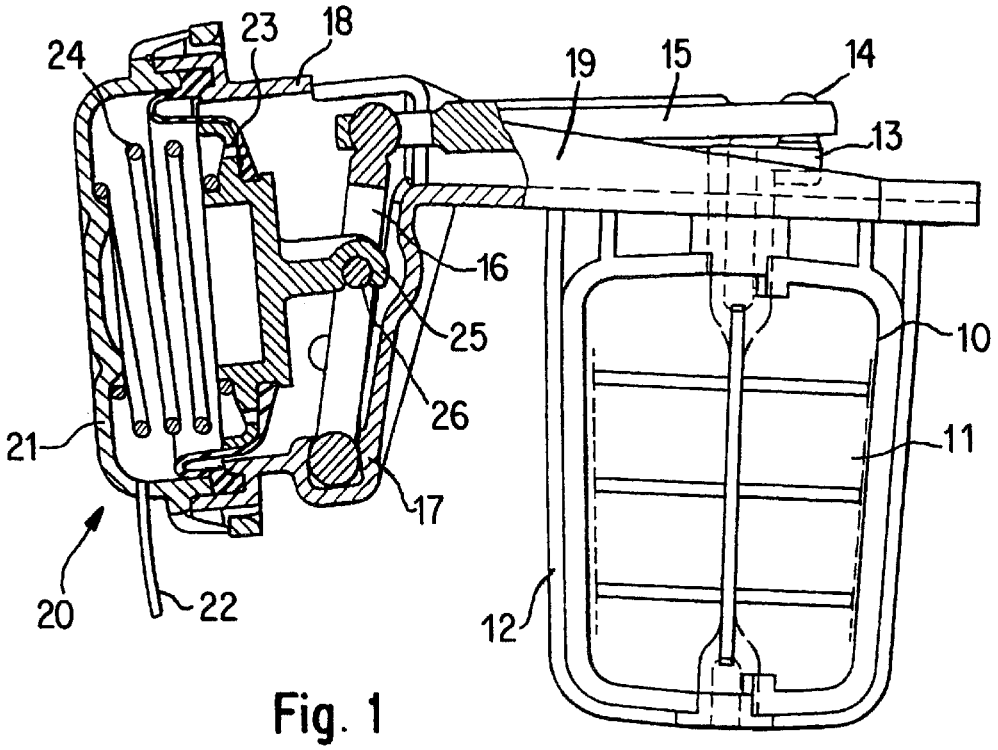
FIG. 1 shows a sectional representation of a device for shifting the position of a valve flap.

The sectional representation according to FIG. 1 shows a passage 10 carrying aspirated air, which is closed by a pivotable flap 11. The pivotable flap 11 is journaled at both ends in a housing 12 and has a lever 13 at the upper journal location. This lever 13 is connected via a ball joint 14 to a traverse rod 15. The traverse rod is in contact on the end opposite the ball joint 14 with a coupling rod 16. The coupling rod 16 is mounted for rotation in a bearing socket 17. An actuator housing 18, which is connected by the flange 19 to the housing 12, carries a vacuum box 20. This vacuum box has a housing cover 21 with a connection 22 for a vacuum hose, not shown here. In the housing cover 21 there is a resiliently mounted diaphragm 23 which is supported against a pressure spring 24. The diaphragm is equipped with a joint hook 25 which encloses a mounting pin 26 on the coupling rod 16. In the position of the pivotable flap 11 shown here, the diaphragm 23 is in the rest position, and no vacuum is applied.

Figure 2:
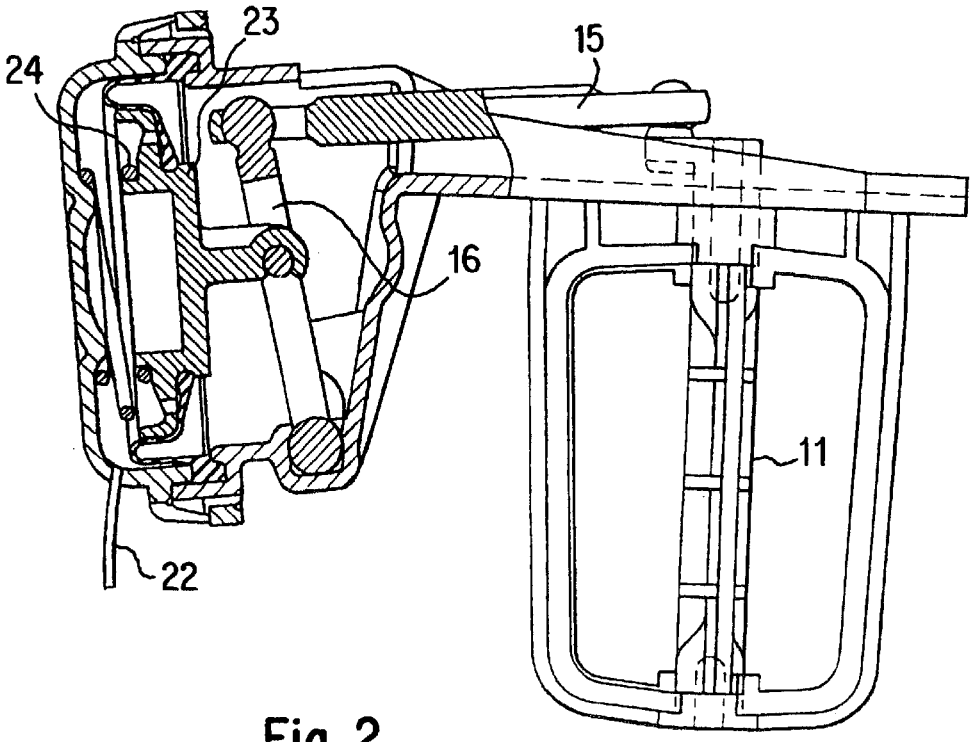
FIG. 2 shows a sectional view according to FIG. 1 with the valve flap open.

FIG. 2 shows the device for shifting the position of a valve flap in the open position. The pivotable flap 11 is rotated by 90° as a result of a vacuum applied to the connection 22. The vacuum produces an axial movement of the diaphragm 23 against the force of the spring 24; this movement is transmitted through the coupling rod 16 and the traverse rod 15 to the pivotable flap 11.

Of course, intermediate positions are also possible. The position of the pivotable flap 11 is dependent on the applied vacuum. Usually, however, the valve flap is operated only between the two positions, closed and open.

Figure 3:
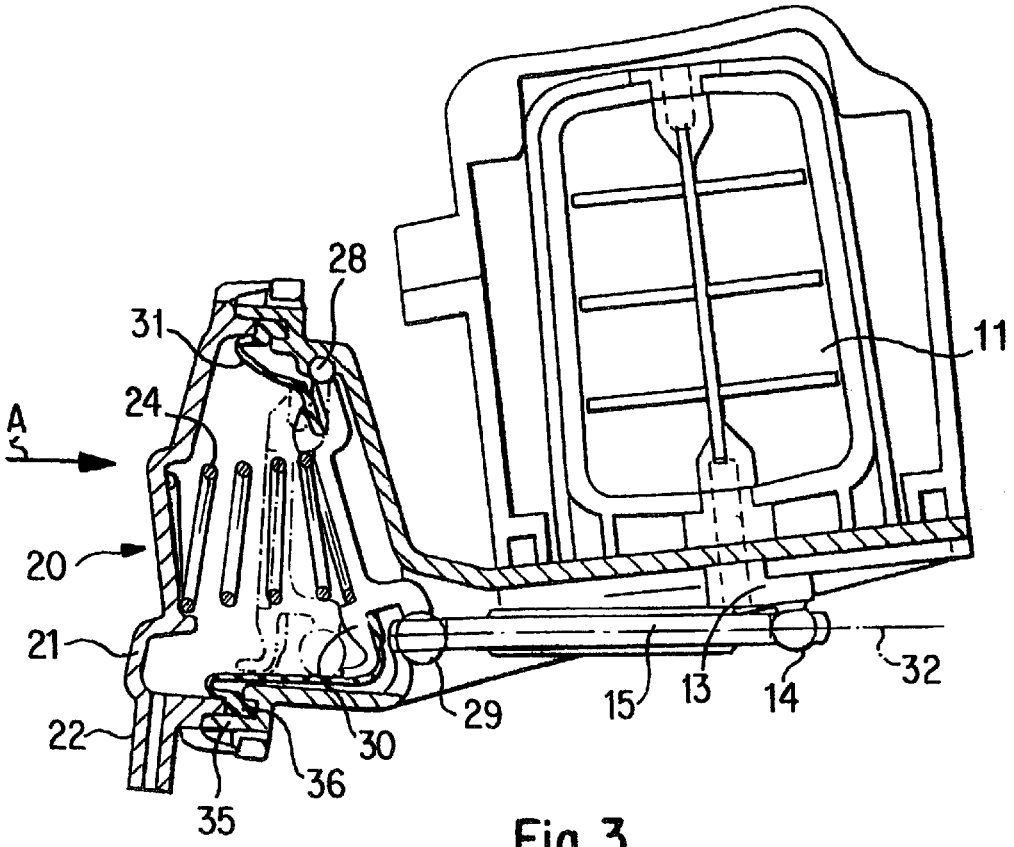
FIG. 3 shows a sectional representation of a device for shifting the position of a valve flap in an embodiment with an asymmetrical vacuum box.
Figure 4:
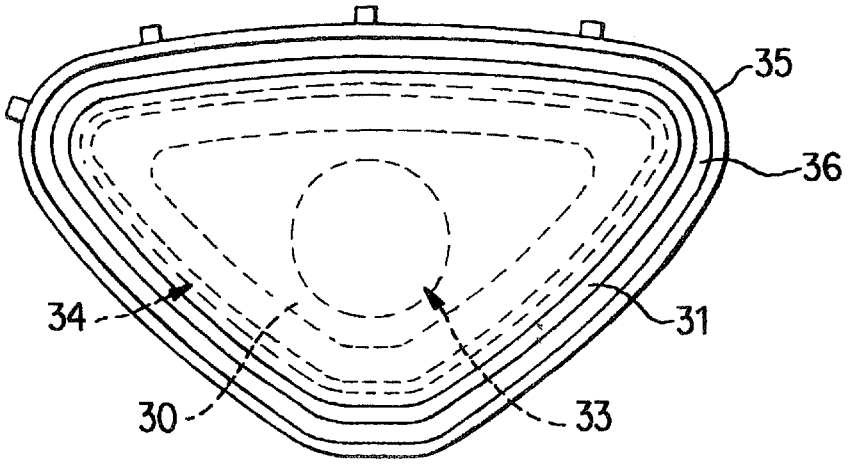
FIG. 4 shows the contour of the asymmetrical diaphragm in the view A in FIG. 2 with the housing cover removed.

FIG. 3 shows the operation of an asymmetrical vacuum box which is connected to the position adjusting mechanism of the throttle valves. The heart of the asymmetrical vacuum box 20 is the hook plate 30 which is connected to the diaphragm 31 and at the same time carries a pivot point 29. It thus combines the functions of a diaphragm disk 27 and coupling rod 16 (FIG. 1). The hook plate is journaled on at least one ball joint 28 in the housing of the vacuum box. The pivot point 29 of hook plate 30, connected to the traverse rod 15, therefore performs a circular movement when the vacuum box is actuated. The throttle valve 11 is thus shifted in position in the same manner as in the embodiment described in FIG. 1. As an alternative to the jointed pivot point 29, a rigid connection can also be provided between the traverse rod and hook plate. In this version the ball joint 28 is omitted, and the hook plate 30 executes a substantially translational movement. The vacuum box is operated by a vacuum which can be applied to a vacuum connection 22 and which acts against a spring 24.

FIG. 3 shows a plan view of the vacuum box with the housing cover 21 removed, viewed from the direction A (see FIG. 2). The hook plate is shown in broken lines. The external contour 34 and the spring socket 33 can be seen. The housing wall 35 of the vacuum box receives the sealing bead 36 of the diaphragm 31.

What is claimed:

1. An apparatus for shifting the position of a valve flap, comprising a diaphragm device which executes a longitudinal movement depending on an applied vacuum, said diaphragm device comprising a coupling rod connected to said diaphragm device to move with the diaphragm; said coupling rod being journaled to one end of a traverse rod; said traverse rod being journaled at its other end to a lever for turning said valve flap between open and closed positions, whereby movement of the diaphragm is transmitted through the coupling rod to the traverse rod and thence to the valve lever; said diaphragm device and said coupling rod being housed in an adjusting member housing which comprises a housing cover for said diaphragm device.

2. An apparatus according to claim 1, wherein said valve flap is disposed in an air intake duct of an internal combustion engine.

3. An apparatus according to claim 1, wherein said coupling rod is constructed to have a variable transmission ratio.

4. An apparatus according to claim 1, wherein said diaphragm device comprises a pivotable diaphragm disk having an integrally formed hook member thereon, said hook member engaging one end of said traverse rod, such that pivoting of the diaphragm disk in response to a vacuum applied to said diaphragm device causes back and forth movement of the traverse rod.

5. An apparatus according to claim 1, wherein said diaphragm device has a diaphragm having a shape with a center of area substantially coincident with a line along which force is outputted from the diaphragm device.

6. An apparatus according to claim 1, wherein said diaphragm has an asymmetrical shape.

7. An apparatus according to claim 1, wherein said diaphragm device comprises a vacuum box.

8. An apparatus according to claim 1, wherein said coupling rod is connected to said traverse rod and said traverse rod is connected to said valve lever by ball joints.

9. An apparatus according to claim 1, wherein one of said coupling rod and said traverse rod comprises a length compensating member.

10. An apparatus according to claim 9, wherein said traverse rod comprises a length compensating member.

11. An apparatus according to claim 1, wherein said diaphragm device comprises a return spring.

12. An apparatus according to claim 1, wherein said diaphragm device and the flap valve are constructed as an integrated modular component of an air intake passageway of an internal combustion engine such that the passageway can be opened or closed by actuation of said flap valve by said diaphragm device.

* * * * *